United States Patent [19]

Bourboulis

[11] 4,126,120

[45] Nov. 21, 1978

[54] HEAT DISTRIBUTION DEVICE

[76] Inventor: Cedric D. Bourboulis, 112 Fountainhead Ct., Martinez, Calif. 94533

[21] Appl. No.: 826,011

[22] Filed: Aug. 19, 1977

[51] Int. Cl.[2] ..... F24C 15/10

[52] U.S. Cl. ..... 126/215; 126/214 C; D7/136

[58] Field of Search ..... 126/27, 42, 50, 214 R, 126/214 C, 214 D, 220; D7/136

[56] References Cited

U.S. PATENT DOCUMENTS

| | | | |
|---|---|---|---|
| 859,659 | 7/1907 | Herrington | 126/215 |
| 2,513,011 | 6/1950 | Duarte | 126/215 |
| 2,760,481 | 8/1956 | Sprung | 126/215 |
| 4,059,092 | 11/1977 | Bourboulis | 126/215 |

*Primary Examiner*—John J. Camby
*Assistant Examiner*—Larry I. Schwartz
*Attorney, Agent, or Firm*—George M. Schwab

[57] ABSTRACT

Apparatus for distributing heat from a heat source relatively evenly over the bottom of a vessel to be heated is disclosed. A first annular element is provided which includes an upwardly concave dish-shaped annulus circumscribing a hollow center. A releasable connecting element of a first type is located on the underside of the first annular element. A second annular element includes an upwardly concave dish-shaped annulus which is larger than the annulus of the first annular element. A releasable connecting element of a second type complementary to the first type is located on the inner periphery of the annulus of the second annular element so that the elements can be locked together for use and disassembled for cleaning.

13 Claims, 5 Drawing Figures

HEAT DISTRIBUTION DEVICE

BACKGROUND OF THE INVENTION

The present invention provides apparatus for distributing heat from a heat source relatively evenly over the bottom of a vessel to be heated.

When vessels used for cooking are placed on the heating element of a stove or another type of heat source, the size of the vessel often mismatches the size of the heat source. If the vessel is much larger than the heat source, heat is only provided at the center of the vessel, and the contents of the vessel may be unevenly heated. This is a particular problem when dishes are to be simmered for a long time at low heat because that portion of the dish at the center of the vessel may be overheated and even scorched while little or no heat may be provided to the reminader of the dish. On the other hand, when a vessel is small relative to the heat source, the heat provided by the heat source beyond the periphery of the vessel is wasted. Such waste of heat energy is a problem not only with electric and gas ranges, but with other types of heat sources such as wood, charcoal and the like in which much of the heat energy is lost.

A device for deflecting heat from a heat source relatively evenly over the bottom of a vessel to be heated is disclosed in my copending patent application entitled HEAT DEFLECTOR, Ser. No. 736,981, filed Oct. 29, 1976, now U.S. Pat. No. 4,059,092, which is herein incorporated by reference. However, the device described therein has been found to be difficult to manufacture because all the elements must be assembled as a completed unit. Moreover, since the elements are fixed together, the device is difficult to clean. Also, because the handle is integral to the device, the handle becomes heated when the device is used and must be handled with care.

SUMMARY OF THE INVENTION

The present invention provides apparatus for distributing heat from a heat source relatively evenly over the bottom of a vessel to be heated which can be assembled for use and disassembled for cleaning. A first annular element is provided which includes an upwardly concave dish-shaped annulus circumscribing a hollow center. A releasable connecting element of a first type is located on the underside of the first annular element. A second annular element includes an upwardly concave dish-shaped annulus which is larger than the annulus of the first annular element. A releasable connecting element of a second type complementary to the first type is located on the inner periphery of the annulus of the second annular element so that the elements can be releasably locked together.

The apparatus of the present invention provides a simple and efficient device which distributes the heat from a large or small heat source evenly over the bottom of the vessel to be heated. If the heat source is large relative to the vessel, the device is placed on the heat source with the dish-shaped annuli opening upwardly to deflect the heat outwardly from the heat source evenly over the bottom of the vessel so that hot spots are not created at the center of the vessel. If the heat source is large relative to the vessel, the device is turned upside down and the heat from the source is directed radially inwardly and distributed evenly over the bottom of the vessel so that all of the heat from the heat source is used and none is wasted.

The apparatus of the present invention is advantageous over the device described in my above-referenced patent in several respects. First, because the elements are not preassembled, the device as a whole is easier and less expensive to manufacutre. Also, the device can be readily disassembled for cleaning. In addition, a handle can be provided which is not integral to the device itself so that the handle does not become heated when the device is used.

In the preferred embodiment of the present invention, wedges are provided on the upper surfaces of the annular elements to support the vessels to be heated. In one of the preferred embodiments, the upper surfaces of these wedges are raised relative to the elements themselves so that air can readily escape from between the heat distribution device and the vessel. This feature is highly desirable when a gas range is being used to prevent the entrainment of air within the device which would interfere with the operation of the gas range.

The novel features which are characteristic of the invention, as to organization and method of operation, together with further objects and advantages thereof will be better understood from the following description considered in connection with the accompanied drawings which preferred embodiments of the invention are illustrated by way of example. It is to be expressly understood, however, that the drawings are for the purpose of illustration and description only and are not intended as a definition of the limits of the invention.

Figure 3:
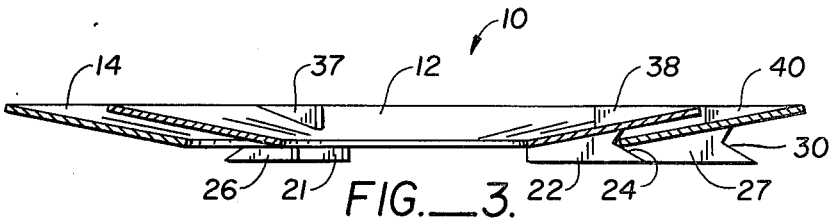
Figure 4:
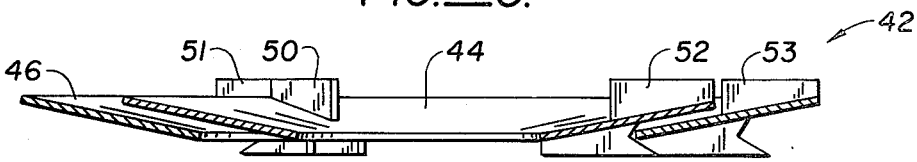

FIGS. *2a* and *b* are plan views of the first and second annular elements respectively of the first embodiment of the present invention;

FIG. 3 is an elevation cross-sectional view of the first embodiment of the present invention;

FIG. 4 is a elevation cross-sectional view of a second embodiment of the present invention.

DESCRIPTION OF THE PREFERRED EMBODIMENTS

Figure 1:
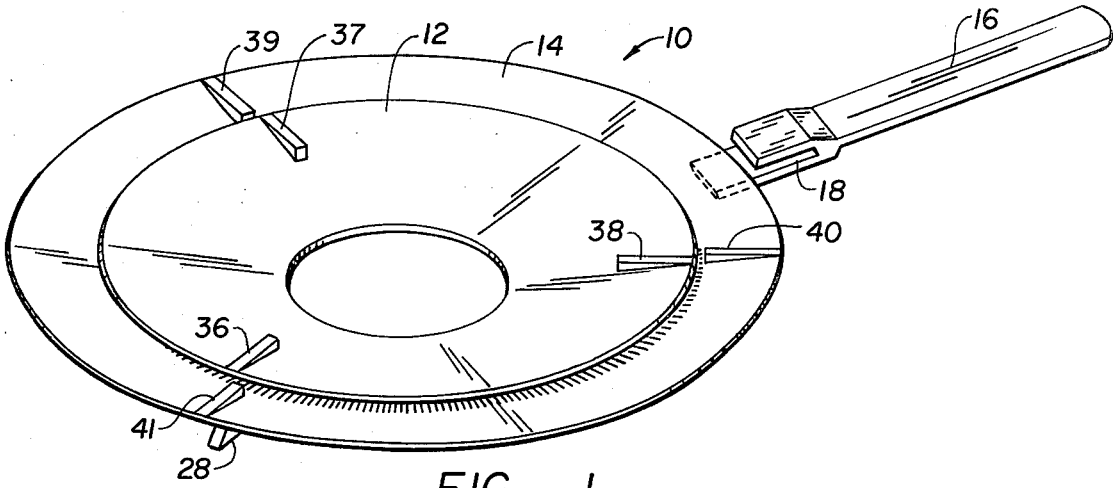
FIG. 1 is a perspective view of the first embodiment of the present invention.
Figure 2A:
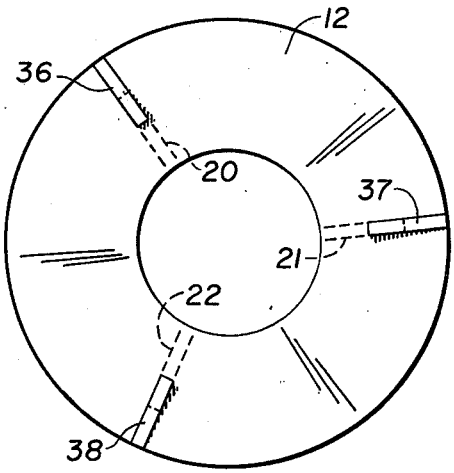
Figure 2B:
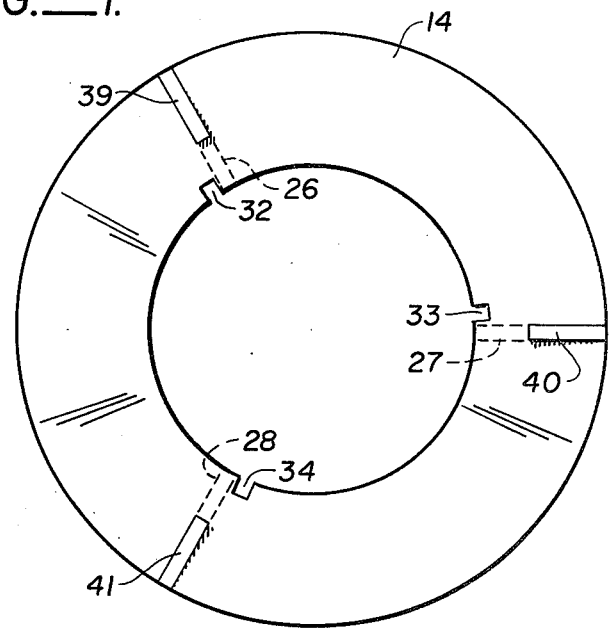

The first preferred embodiment 10 of the apparatus of the present invention is illustrated by way of reference to FIGS. 1–3 in combination. Heat deflector 10 includes first and second annular elements 12, 14 each comprising an upwardly concave, dish-shaped annulus. Elements 12, 14 are constructed of a metal or other material capable of withstanding high heat. Element 14 is larger than element 12 so that the elements are capable of nesting as illustrated in FIGS. 1 and 3. A handle 16 is provided having a transverse groove 18 which can engage the outer rim of element 14 to lift the elements 12 and 14 when desired. Handle 16 is readily detachable from elements 12, 14 so that it will not become heated when the elements themselves are in use.

Element 12 includes a plurality of foot members 20–22. Each foot member 20–22 has a flat bottom and a radially outwardly opening groove such as 24 at its outer periphery. Corresponding foot members 26–28 are located on the underside of element 14, and each such foot member is again provided with radially outwardly opening grooves such as 30.

A plurality of slots 32–34 are formed in the inner periphery of element 14. The position of slots 32–34 correspond with the positions of foot members 20–22 on element 12. To assemble elements 12 and 14, element 12 is superimposed over element 14, and the foot members 20–22 on element 12 inserted partially through the slots 32–34 on element 14 until the slots are juxtaposed to the grooves such as 24 on the foot members. Element 12 is rotated counterclockwise with respect to element 14 until foot member 20–22 of element 12 are in abuttment with foot members 26–28 of element 14. In this position, elements 12 and 14 are locked together and should not accidentally become disengaged.

Although only two elements 12, 14 have been illustrated herein, three or more such elements could actually be used. The elements would be progressively larger and attached to one another as element 14 attaches to 12.

Elements 12 and 14 each have a plurality of wedges 36–41 with flat upper surfaces on their tops sides. When a large vessel is to be heated on a relatively small heat source, elements 12, 14 are locked together as discussed above, and are located on the heat source with the elements 12, 14 opening upwardly. Elements 12, 14 will be supported on foot members 20–22 and 26–28 which rest on the heat source. The vessel to be heated rests on the wedges 36–41 on the upper surfaces of the elements. In this configuration, elements 12, 14 will deflect the heat outwardly from the heat source to distribute it relatively evenly over the underside of the vessel.

When the device of the present invention is to be used with a heat source which is large relative to the vessel to be heated, the elements 12, 14 are locked together and inverted so that the elements open downwardly. The element will be supported on the heat source by wedges 36–41, and the vessel supported on foot members 20–22 and 26–28. In this configuration, elements 12, 14 will deflect the heat inwardly to distribute it over the bottom of the smaller vessel to prevent a waste of heat energy.

When the heat deflector such as that illustrated herein is utilized with a gas range, it is essential that a gap be provided between the deflector and the vessel to be heated to allow for heated air to escape. Accordingly, an alternate embodiment 42 of the present invention has been developed as depicted in FIG. 4. In this embodiment, annular elements 44, 46 are provided which nest together and engage one another as in the first embodiment. However, in deflector 42, wedges such as 50–53 are provided with upper surfaces which are raised relative to annular elements 44. As a result, a gap is provided between the annular element and the underside of the vessel to be heated to allow heated air to escape.

In both of the above described embodiments, the elements 12, 14 (or 44, 46) and handle 16 can be manufactured individually and sold as a kit. The user can assemble the annular elements for use of the device. and later disassemble the elements for cleaning. In this manner, highly efficient, practical heat deflector is provided by the apparatus of the present invention.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. Apparatus for distributing heat from a heat source relatively evenly over the bottom of a vessel to be heated, said apparatus comprising:

a first annular element including an upwardly concave dish-shaped annulus circumscribing a hollow center, said first element including means on the underside thereof for defining releasable connecting means of a first type; and a second annular element including an upwardly concave dish-shaped annulus circumscribing a hollow center, the inner and outer diameters of said second annular element being larger than the respective diameters of the first annular element, said second element including the means on the inner periphery of the annulus thereof for defining releasable connecting means of a second type complementary to said first type so that the connecting means of the second type is releasably engageable with the connecting means of the first type to lock the annular elements together.

2. Apparatus as recited in claim 1 wherein the releasable connecting means of said first type comprises means for defining a plurality of radially outwardly directed grooves located on the underside of the first element, and wherein the releasable connecting means of the second type comprises a plurality of slots on the inner periphery of the annulus thereof corresponding to the groove defining means of the first annular element so that the first annular element can be superimposed over the second annular element, the groove defining means inserted through the slots, and the first and second annular elements rotated with respect to one another to lock the annular elements together.

3. Apparatus as recited in claim 2 wherein the first annular element includes at least three foot members depending from the underside of said first element for supporting the first element on the heat source, and wherein the groove defining means comprises radially outwardly directed grooves formed in the foot members.

4. Apparatus as recited in claim 1 and additionally comprising an elongate handle having a transverse groove in one end thereof, said groove adapted to be engaged with the outer periphery of the concave dish-shaped annulus of the second annular element to raise and lower the first and second annular elements in combination.

5. Apparatus for distributing heat from a heat source relatively evenly over the bottom of a vessel to be heated, said apparatus comprising:

a first annular element including an upwardly concave dish-shaped annulus circumscribing a hollow center, said first element having at least three foot members depending from the underside of said first element for supporting the first element on the heat source and means for defining a plurality of radially outwardly directed grooves located on the underside of first element; and a second annular element including an upwardly concave dish-shaped annulus circumscribing a hollow center, the inner and outer diameters of said second annular element being larger than the respective diameters of the first annular element, and at least three foot members depending from the underside of said element for supporting the second annular element on the heat source, said second annular element having a plurality of slots on the inner periphery of the annulus thereof corresponding to the groove defining means of the first annular element so that the first annular element can be superimposed over the second annular element, the groove defining means inserted through said slots and the first and second annular elements rotated with respect to one another to lock the annular elements together.

6. Apparatus as recited in claim 5 wherein the groove defining means comprises radially outwardly directed grooves formed in the foot members of the first element.

7. Apparatus as recited in claim 5 wherein the second annular element includes means for defining a plurality of radially outwardly directed grooves located on the underside of said second element for attachment of a third annular element thereto.

8. Apparatus as recited in claim 5 and additionally comprising a plurality of wedge members located on the top of the first annular element and the second annular element, said wedge members having horizontal upper surfaces to support the bottom of the vessel to be heated.

9. Apparatus as recited in claim 8 wherein the upper surface of said wedge members is raised relative to the upwardly concave dish-shaped annuli of said first and second annular elements to provide a gap between said annuli and the bottom of the vessel to be heated to allow for the escape of heated air.

10. Apparatus as recited in claim 5 and additionally comprising an elongate handle having a transverse groove at one end thereof, said groove adapted to be engaged with the outer periphery of the concave dish-shaped annulus of the second annular element to raise and lower the first and second annular elements in combination.

11. Apparatus for distributing heat from a heat source relatively evenly over a bottom of a vessel to be heated, said apparatus comprising:

a first annular element including an upwardly concave dish-shaped annulus circumscribing a hollow center, said first element having at least three foot members depending from the underside of said first element for supporting the first element on the heat source, said foot members each having a radially outwardly directed groove on the outer periphery thereof;

a second annular element including an upwardly concave dish-shaped annulus circumscribing a hollow center, the inner and outer diameters of said second annular element being larger than the respective diameters of the first annular element, and at least three foot members depending from the underside of said element for supporting the second annular element on the heat source, said second annular element having a plurality of slots in the inner periphery of the annulus thereof corresponding to the foot members of the first annular element so that the first annular element can be superimposed over the second annular element, the foot members inserted through said slots and the first and second annular elements rotated with respect to one another to lock the annular elements together; and a plurality of wedge members located on the top of the first annular element and the second annular element, said wedge members having horizontal upper surfaces to support the bottom of the vessel to be heated.

12. Apparatus as recited in claim 11 wherein the upper surface of said wedge members is raised relative to the dish-shaped annuli of said first and second annular members to provide a gap between said annuli and the bottom of the vessel to be heated to allow for the escape of heated air.

13. Apparatus as recited in claim 10 and additionally comprising an elongate handle having a transverse groove at one end thereof, said groove adapted to be engaged with the outer periphery of the concave dish-shaped annulus of the second annular element to raise and lower the first and second annular elements in combination.

* * * * *